US006460294B1

(12) United States Patent
Harkins

(10) Patent No.: US 6,460,294 B1
(45) Date of Patent: Oct. 8, 2002

(54) WINDOW AND DOOR OPENING AND CLOSING MECHANISM

(76) Inventor: Peter W. Harkins, Tobruk Homestead, RMB 116, Old Northern Road, Maroota, New South Wales, 2756 (AU)

( * ) Notice: Subject to any disclaimer, the term of this patent is extended or adjusted under 35 U.S.C. 154(b) by 0 days.

(21) Appl. No.: 09/579,601

(22) Filed: May 26, 2000

Related U.S. Application Data

(63) Continuation-in-part of application No. PCT/AU98/00982, filed on Nov. 26, 1998.

(51) Int. Cl.[7] ..... E05F 11/28
(52) U.S. Cl. ..... 49/345; 49/341
(58) Field of Search ..... 49/345, 252, 246, 49/260, 279, 341

(56) References Cited

U.S. PATENT DOCUMENTS

| | | | | |
|---|---|---|---|---|
| 1,478,856 A | | 12/1923 | Hockenberry | |
| 1,903,120 A | | 10/1933 | Behnke | 268/62 |
| 2,248,337 A | | 7/1941 | Carroll | 268/117 |
| 4,937,976 A | * | 7/1990 | Tucker et al. | 49/345 |

FOREIGN PATENT DOCUMENTS

| | | |
|---|---|---|
| AU | 16932/24 | 3/1924 |
| DE | 85992 | 7/1920 |
| FR | 1306060 | 9/1962 |
| WO | WO99/28582 | 10/1999 |

* cited by examiner

*Primary Examiner*—Curtis Cohen
(74) *Attorney, Agent, or Firm*—Eugene Stephens & Associates

(57) ABSTRACT

A window and door opening and closing mechanism is disclosed which is particularly well suited for use in casement and awning window fittings. The opening/closing mechanism has a hinge arrangement with two linked arms pivoting from a runner which may be attached to the window frame. One or both of the pivoting arms is mounted to the runner on a slider which is movable along the runner in relation to the pivot mounting of the other arm. The mechanism is operable by way of a cable or cord which has portions wound around a spool which is rotatable by the user. Winding the spool in one direction applies a tension to one portion of the cord or cable to apply a force between the pivot mountings of the arms and draw them together on the runner to open the window by pivoting the arms outwardly from the window frame. Winding the spool in the other direction applies a tension to another portion of the cord or cable coupled to one of the arms to draw them back toward the runner and close the window. When tension is first applied to the opening cable portion, initial limited movement of a wedge member can be used to initiate angular movement of the arms whilst the respective pivot mountings thereof are substantially aligned along the runner.

23 Claims, 8 Drawing Sheets

WINDOW AND DOOR OPENING AND CLOSING MECHANISM

RELATED APPLICATIONS

This application is a Continuation-In-Part of International Patent Application No. PCT/AU98/00982, filed Nov. 26, 1998, entitled WINDOW AND DOOR OPENING AND CLOSING MECHANISM, which parent application is hereby incorporated by reference.

TECHNICAL FIELD

This invention relates to a mechanism for opening and closing windows and doors.

BACKGROUND

Many different forms of mechanisms for opening and closing windows in a domestic environment are available, including extendable chain arrangements and mechanical lever arms. Each mechanism has its own inherent advantages and disadvantages which make them suitable for various applications such as window and hinge types. Presently available opening and closing mechanisms for awning and casement windows are primarily of a mechanical linkage type, separate from the mechanical hinge arrangement which couples the window to the frame, and generally comprise a form of lever arm extending from the frame to the window sash. The lever arm may typically be extendable from an orientation generally parallel to the frame (window closed) to an orientation transverse to the frame (window open) by means of a geared coupling from the lever arm to a rotatable handle or the like that is operable by the user.

SUMMARY OF THE INVENTION

Embodiments of the present invention aim to provide an opening and closing mechanism for windows and doors which operates by way of a cord or cable, for example, which, when an appropriate tension is applied, causes the window/door to open or close. For closing of the window, for example, the cord or cable tension may be applied directly between the window sash and the frame, and for opening the window the tension may be applied to an arm of the hinge by which the window is mounted to the frame. The mechanism is particularly well adapted for use in casement and awning window fittings.

In accordance with the invention, there is provided a mechanism for hinged opening and closing movement between first and second components wherein the first and second components comprise a window or door and a window or door frame, comprising a runner mounted to the first component, a connecting arm mounted at one end for pivotal movement on a first pivot mounting coupled to the runner, the other end of the connecting arm being adapted for pivotal connection to the second component, an opening cord or cable coupled to exert a tension force between a hinged or pivotal connection of the first and second components and said first pivot mounting substantially along said runner so as to effect a relative movement toward one another along said runner as between said hinged or pivotal connection and said first pivot mounting, a closing cord or cable adapted for connection to said second component for exerting a tension force between said first and second components for angular movement of said first and second components toward one another, and a winding mechanism coupled to the opening and closing cords or cables for applying said respective tension forces to the opening and closing cords or cables.

In accordance with the present invention, there is also provided an opening and closing mechanism for a window or door comprising an elongate frame member, first and second pivot mount members coupled to the frame member towards opposite ends thereof and at least one of the first and second pivot mount members being slidable along the frame member so that the first and second pivot mount members are movable relative to one another, a lever arm having one end pivotally coupled to the first pivot mount member to enable pivotal movement thereof relative to the frame member between a closed position where the lever arm is substantially parallel to the frame member and an open position where the lever arm is transverse to the frame member, a connecting arm having one end pivotally coupled to the second pivot mount member and the other end pivotally coupled at an intermediate portion of the lever arm, an opening cord or cable portion which is coupled to one or both of the first and second pivot mount members for applying a force therebetween to effect relative movement of the first and second pivot mount members toward each other along the frame member for opening of the window or door, a closing cord or cable portion which is coupled between the connecting arm or lever arm and the frame member for applying a force therebetween to effect relative angular movement of the lever arm and connecting arm toward the frame member for closing of the window or door, and a winding mechanism for winding and unwinding the opening and closing cord or cable portions to apply said forces for opening and closing of the window or door, in use.

Preferably the first pivot mount member includes a wedge member positioned to slide along the frame member between the second pivot mount member and a lever arm mounting of the first pivot mount member, and wherein the wedge member is coupled to the opening cord or cable portion and is relatively movable with respect to the lever arm mounting over a limited distance along the frame member. The wedge member may be coupled to the lever arm mounting by way of a tension spring and sliding spring limit arms interconnecting the wedge member and lever arm mounting to limit the separation thereof and thus limit extension of the tension spring. Preferably the wedge member has a wedge surface which, upon relative movement of the first and second pivot mount members toward one another, acts against the end of the connecting arm coupled to the lever arm to force the connecting arm and lever arm angularly out from the frame member.

The winding mechanism preferably includes a rotatable spool upon which the opening and closing cord or cable portions are wound, in use, and wherein the opening and closing cord or cable portions are coupled around the spool such that winding the opening cord or cable portion onto the spool unwinds the closing cord or cable portion therefrom, and vice versa. The opening and/or closing cord or cable portion may be coupled between the winding mechanism and the frame member by way of a cable sheath.

In one form of the invention, the spool includes separate guiding slots for the opening cord or cable portion and the closing cord or cable portion, and wherein each of the opening and closing cord or cable portions have an end portion affixed in relation to the spool. The guiding slot in the spool for the closing cable portion may be formed in a spiral and have a variable winding radius.

The winding mechanism can be provided with a ratchet mechanism which allows rotation of the spool in one direction by application of tension on the opening cable, and prevents rotation of the spool in the other direction upon application of tension on the closing cable. In this case, the driving means may be coupled to the spool by way of a cam action mechanism to disengage said the ratchet mechanism and allow the driving mechanism to drive the spool.

In a particular embodiment of the invention an opening/closing mechanism for opening and/or closing a window comprises a hinge arrangement having a lever arm with a first end pivotally mounted to the window frame with the first pivotal end being slidably movable substantially parallel to the window frame and a second end mounted to the window sash, a rotatable spool, and a flexible cord, cable or the like which has a first end affixed in relation to the window frame, in use, and a second end attached to the second end of the lever arm or to the window sash, wherein the cord, cable or the like passes from the first end to a transition mounting comprising an aperture, roller, pulley or the like mounted for movement with the first end of the lever arm, at least once around the spool, and to the second end attached to the window sash.

Preferably the transition mounting is provided on a slide member which is slidably movable along the same axis as the first end of the lever arm, and is attached said first end by way of a tension spring. Preferably extension of the tension spring is limited to a predetermined length by a limiting means such as a fixed length cord or cable, or a pair of arms having respective interfitting slot and lug formations which are relatively slidable to a fixed extent.

In a preferred form of the invention, the mechanism includes an elongate runner frame which, in use, is mounted along the window frame, with the lever arm arranged to extend along an edge of the window sash, in use. The runner frame preferably has a track along which the first end of the lever arm, and the slide member, are slidably movable. With the mechanism in a "closed window" configuration the lever arm extends generally parallel to the runner frame and first end of the lever arm is disposed to a first end of the runner frame, with the rotatable spool mounted at the other, second end of the runner frame. In this configuration the second end of the lever arm is disposed adjacent the spool. The slide member having the cord transition mounting is disposed along the runner frame between the lever arm first end and the spool. A connecting arm is preferably provided having a first end pivotally connected to the runner frame between the first and second ends thereof, and a second end pivotally connected intermediate the first and second ends of the lever arm. The slide member is preferably formed with an angled wedge portion which, upon initial movement of the slide member from the "closed window" configuration of the mechanism, is forced between the track of the runner frame and the second end of the connecting arm so as to force the connecting arm and lever arm transversely outward from the runner frame.

The spool and the first end of the connecting arm may alternatively be mounted to a frame block which is detachably coupled to the runner frame at the second end thereof. This arrangement facilitates attachment and detachment of the spool and connecting arm to/from the runner frame in a single unit, which allows the slide member and lever arm to also be coupled and decoupled to/from the runner frame track towards the second end thereof, which in turn enables easier mounting of the lever arm to the window sash and the runner frame to the window frame during installation as well as removal of the window sash from the frame for maintenance or the like.

The slide member may act upon the second end of the connecting arm as mentioned above, but may alternatively or additional act upon a lug or the like which extends from the connecting arm or even from the lever arm itself. In this way the distance from the pivot points of the connecting and lever arms can be tailored to provide a suitable force upon the arms for movement thereof upon a suitable force being applied to the slide member according to the angle of the wedge portion. Furthermore, a plurality of slide members may be utilised in some applications, acting at separate points along the connecting arm and/or lever arm to provide the required pivotal movement of the arms outwardly from the runner frame at the beginning of the hinge movement.

DRAWINGS

The invention is described in greater detail hereinafter, by way of example only, with reference to the accompanying drawings illustrating an embodiment thereof, in which.

DETAILED DESCRIPTION

Figure 1:
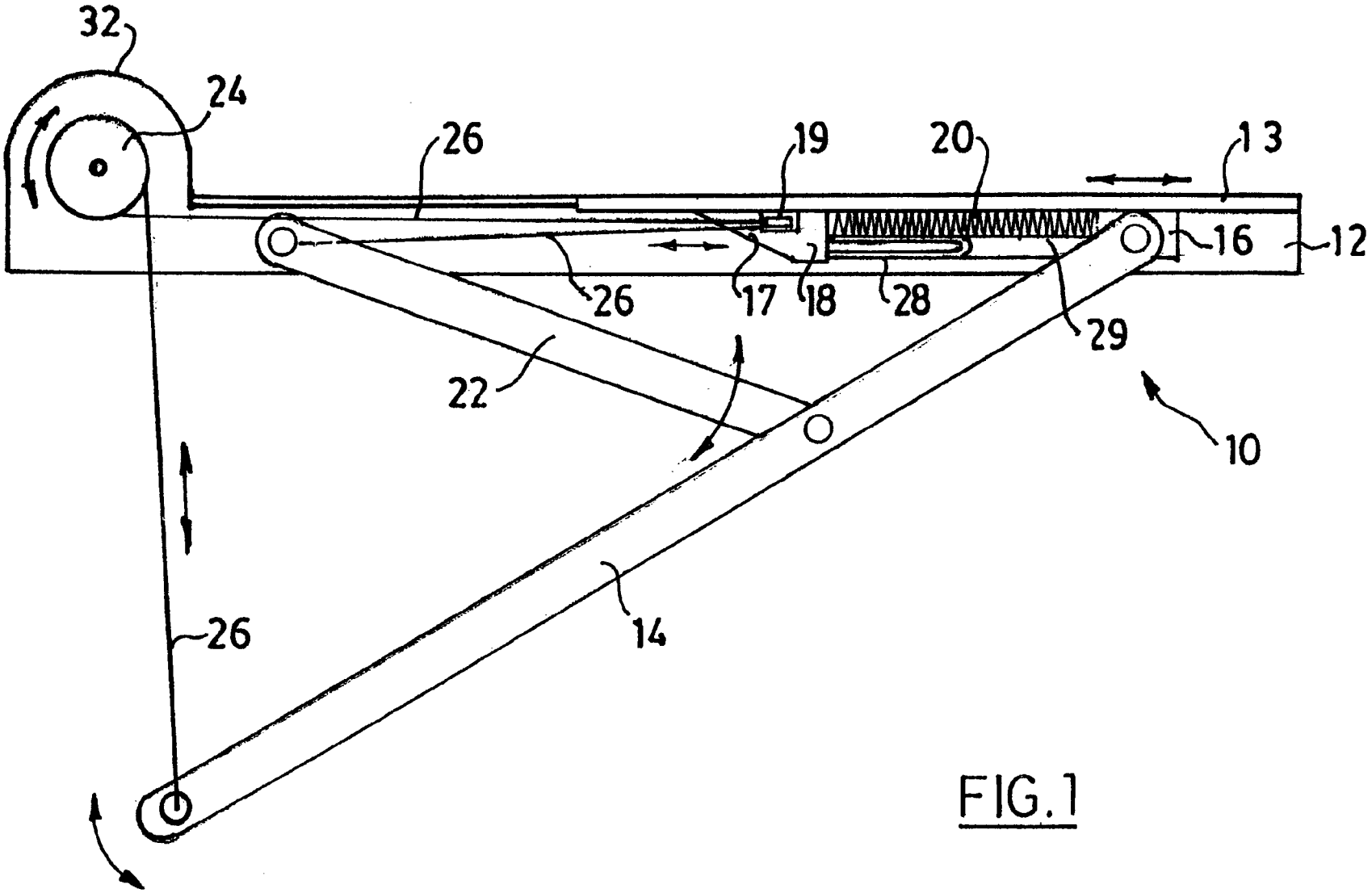
FIG. 1 is a plan view of the main components of a window opening/closing mechanism, in a partially open configuration, constructed according to one form of the present invention.
Figure 2:
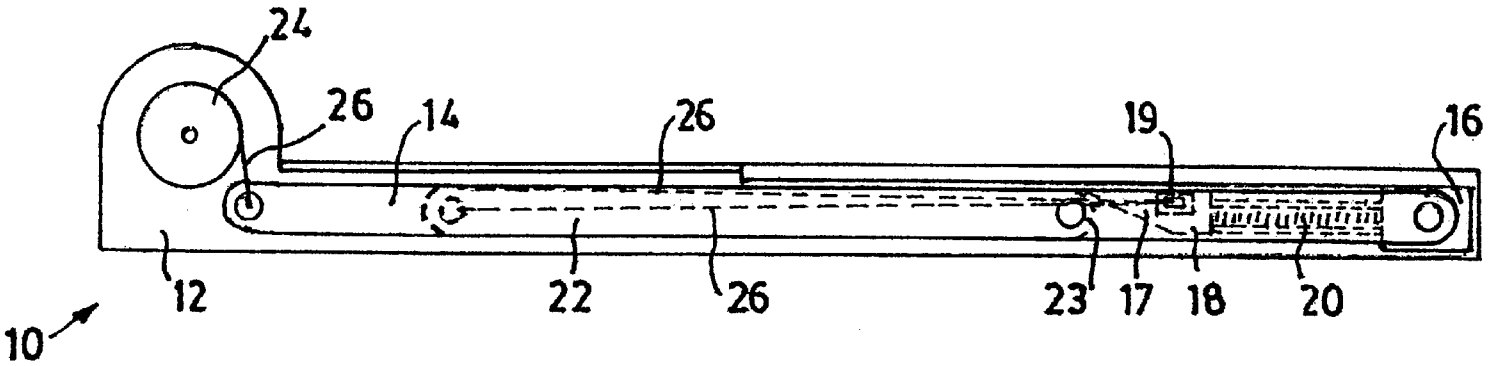
FIG. 2 is a plan view of the window mechanism in a closed configuration.
Figure 3:
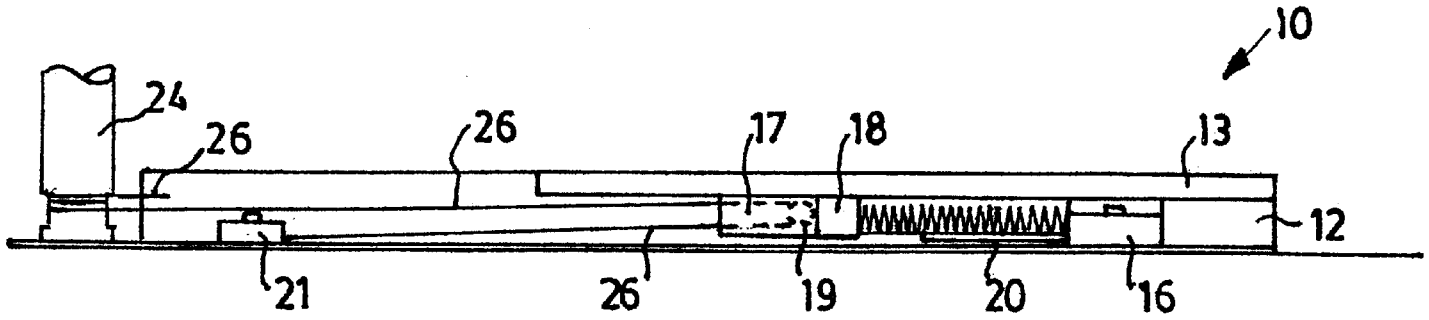
FIG. 3 is a side view of the window mechanism with arms removed.

A window mechanism 10 is illustrated in FIGS. 1 to 3 which is particularly adapted for use with casement or awning window fittings. The window mechanism 10 is based upon a widely used awning or casement hinge which comprises generally an elongated runner frame 12, a lever arm 14 and a connecting arm 22. The runner frame 12 has a track 13 along one edge thereof, and a slider mounting 16 which is constructed for sliding movement along the track 13. One end of the lever arm 14 is pivotally mounted to the slider mounting 16. The connecting arm 22 has one end pivotally mounted to the runner frame 12, and the other end pivotally attached intermediate the ends of the lever arm 14.

In use of the known hinge mechanism, the runner frame is mounted along a window frame, and the lever arm 14 attached along an edge of the window sash, with a corner of the window sash being adjacent the end of the lever arm 14 which is mounted to the slider mounting 16. FIG. 2 illustrates the window mechanism 10 with the hinge in a configuration in which, in use, the window would be closed. In this case, both the lever arm 14 and connecting arm 22 lie parallel to the runner frame 12 with the slider mounting 16 disposed to one end of the runner frame. As the window is opened the lever arm 14 pivots out from the runner frame whilst the slider mounting 16 slides along the track 13. The connecting arm 22 guides the movement of the lever arm.

It is possible to operate the hinge of the window mechanism 10 by movement of the slider mounting 16 along the track 13. However, with the hinge in its closed configuration (FIG. 2) the three pivot points at which the lever arm, connecting arm and runner frame are interconnected are at least substantially in line, and this mechanical arrangement means that a very high force must be applied to the slider mounting 16 parallel to the track 13 for the initial opening movement of the window. Furthermore, it is when the window is in its near-to closed position that the most force is 10 required for movement on the hinge in any event, due to the friction of window seals and sash sag. Once the pivot point interconnecting the lever arm 14 and connecting arm 22 has moved a small distance transversely of the runner frame 12, the linear force on the slider mounting 16 which is required for further movement of the lever arm is greatly reduced, in view of the angle of the connecting arm 22 from the runner frame.

The window mechanism 10 incorporates means for opening and closing a window by operating the hinge mechanism above described.

Generally speaking, a cord 26 is provided through which tension may be applied to apply a force to the slider mounting 16 parallel to the runner frame 12 for opening of the window, and to the projecting end of the lever arm 14 transversely of the runner frame for closing of the window.

A slide member 18 is mounted to the runner frame 12 for slidable movement along the track 13 thereof between the slider mounting 16 and the pivotal connection of connecting arm 22 and the runner frame. The slide member 18 is coupled to the slider mounting 16 by way of a tension spring 20. The slide member 18 also has an angled wedge portion 17 on its end toward the mounting of the connecting arm 22. The slide member 18 also has a transition mounting around which the cord 26 is able to pass in order to apply a linear force to the slide member toward the connecting arm 22 along the track 13.

The tension spring 20 interconnecting the slider mounting 16 and slide member 18 is provided to enable the slide member to move along the track to a predetermined extent, upon a force being applied thereto by the cord 26, whilst the slider mounting remains relatively stationary. The force transmitted to the slider mounting from the slide member increases as the extension of the tension spring increases. The length to which the tension spring may extend is limited by a limiting means illustrated in the form of a pair of relatively slidable arms 28, 29. The arm 28 extends from the slide member 18 in the direction of the slider mounting 16 adjacent to the spring 20, and the arm 29 extends from the slider mounting toward the slide member also adjacent the spring. The ends of the arms 28, 29 overlap one another, and arm 28 is formed with a longitudinal slot whilst arm 29 has a transversely projecting lug which fits into the slot of arm 28. When the spring is unextended the arms 28, 29 overlap over most of their lengths and the lug of arm 29 lies in the slot of arm 28 near to the end of arm 28 which is attached to the slide member 18. When the spring is extended the lug slides along the slot until it reaches the end of the slot toward the slider mounting, which prevents further extension of the spring 20.

A rotatable spool 24 is mounted to the runner frame, with an axis of rotation parallel to the pivot axes of the lever and connecting arms. The spool 24 is mounted at an end of the runner frame opposite to that at which the slider mounting 16 is disposed in the "closed window" configuration of the mechanism. The cord 26 extends from the projecting end of the lever arm 14, and is coiled several times around the circumference of the spool 24. The cord then extends along the runner frame 12 to the transition mounting of the slide member 18. The cord passes around the transition mounting and back along the runner frame to where its end is affixed, for example, adjacent the pivotal connection of the connecting arm 22 and runner frame 12. The transition mounting on the slide member 18 may comprise simply an aperture through which the cord 26 can pass and slide, in use, or may be in the form of a roller, pulley or the like in order to reduce friction between the cord 26 and slide member as the cord passes through the transition mounting during movement of the slide member.

Figure 4:
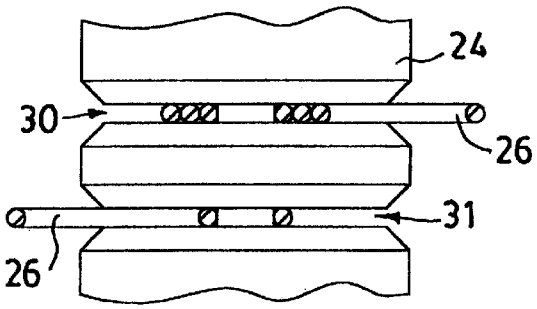
FIG. 4 is a side view of an alternate spool arrangement.

The spool may be arranged so that the cord 26 wraps therearound in a non-overlapping fashion, or may be arranged so that the cord coils upon itself as illustrated in FIG. 4. FIG. 4 is a side view of one form of the spool shown with the coils of cord in cross-section. This form of the spool has separate coiling slots 30, 31 for the respective portions of the cord 26 which extend to the transition mounting on the slide member 18 and to the end of the lever arm. The cord 26 is arranged to coil upon itself in the slots 30, 31, and the cord is coiled in opposite rotational senses in the respective slots. In this form of the spool the cord 26 may pass between the coils in slots 30, 31 through the centre of the spool, or the cord may terminate at the hub of each slot (i.e., the cord 26 may comprise two separate sections). The coiling arrangement shown in FIG. 4 has certain advantages in that, because a greater amount of cord is wound on or off of the spool depending upon the rotational orientation of the spool and the amount of cord already an the spool, the spool can be arranged to wind off more cord and wind on less, and vice versa, where required by the mechanical arrangement of the hinge mechanism.

Operation of the window mechanism 10 is as follows. From the "closed window" configuration illustrated in FIG. 2, the spool 24 can be rotated in only one direction since the lever arm 14 is at the extreme end of its motion toward the frame. In the arrangement shown in FIGS. 1 and 2, clockwise rotation of the spool 24 results in an "opening" movement of the window mechanism, whilst rotation in the counter clockwise direction results in a "closing" movement. Thus, from the "closed window" configuration, clockwise rotation of the spool 24 results in a tension being applied to the portion of the chord 26 which extends between the spool and the slide member 18. In the case of the spool arrangement in which the cord is coiled in non-overlapping fashion, the tension results from frictional forces between the circumferential surface of the spool 24 and the coils of cord 26 which extend therearound. In the case of the spool arrangement in FIG. 4, for example, a portion of the cord 26 is affixed at the hub of the spool. The tension applied to this portion of the cord 26 extends to the fixed end mounting thereof to the runner frame 12, and as a result is transferred to the slide member 18 through the transition mounting through which the chord passes. This tension results in movement of the slide member 18 along the track 13 against the bias of tension spring 20. As the slide member 18 moves along the track, the wedge portion 17 is forced between the track 13 and the second end 23 of the connecting arm at which the connecting arm is pivotally connected to the lever arm. Thus, movement of the slide member 18 forces the arms 14 and 22 to angle outwardly from the runner frame by means of the wedge portion, without requiring large forces applied to the slider mounting 16. In any event, however, the slide member 18 is coupled to the slider mounting 16 by way of the tension spring 20 and limiting means, such that once the arms 14, 22 are angle sufficiently through the wedge action of the slight member, the linear force applied on the slider mounting 16 by the tension spring and/or limiting means is sufficient to enable further angular displacement of the lever arm 14, opening the window.

Simultaneously, the cord 26 is wound off of the spool 24 towards the projecting end of the lever arm 14, and any difference in the displacements of the slide member 18 and lever arm projecting end is taken up by the tension spring 20.

In variations to the above mentioned construction, the wedge portion 17 of the slide member may act between a lug or the like which projects from the connecting arm or lever arm, instead of the end of the connecting arm. Further, a plurality of slide members may be provided, coupled to one another by fixed length elements or springs, wherein each slide member acts upon a respective lug or the like positioned on the connecting arm or lever arm, in order to facilitate improved movement of the hinge mechanism from the fully closed configuration to a configuration where the tension applied to the slider mounting 16 is able to effect further movement of the hinge.

It may be advantageous to construct the window mechanism such that the spool and the first end of the connecting arm are mounted to a frame block (indicated generally at 32 in FIG. 1) which is detachably coupled to the runner frame at the second end thereof. This arrangement facilitates attachment and detachment of he spool 24 and connecting arm 22 to/from the runner frame 12 in a single unit, which allows the slide member and lever arm to also be coupled and decoupled to/from the runner frame track towards the second end thereof. This in turn enables easier mounting of the lever arm to the window sash and the runner frame to the window frame during installation as well as removal of the window sash from the frame with the window mechanism 10 still attached to the respective parts, for maintenance, cleaning or the like. The frame block 32 is preferably adjustable with respect to the runner frame in the longitudinal direction thereof.

Referring particularly to FIG. 1, if the window mechanism 10 is to be moved towards its closed position, then the spool 24 is rotated in the counter clockwise direction. This applies a tension to the portion of the cord 26 which extends between spool 24 and the end of lever arm 14. Because of the distance between the projecting end of lever arm 14 and the pivoting end coupled to slider mounting 16, it is not necessary to apply a large force to the lever arm or a large tension on the cord 26 in order to effect movement of the lever arm and the window attached thereto back to the closed position, even at the end of the movement to the "closed window" configuration, in view of the cord or cable coupling the lever arm to the window frame being arranged transversely, preferably generally at right angles, to the projecting end of the lever arm whilst in that configuration. When the spool 24 is rotated in the counter clockwise direction the portion of the cord 26 extending between the spool 24 and slide member 18 is wound off of the spool, which allows the slide member 18 to move back towards the slider mounting 16. This eases the tension on tension spring 20 and enables sliding movement of the slider mounting 16 back towards the end of runner frame 12 whilst the lever arm 14 and connecting arm 22 pivot about their mountings to the runner frame 12.

FIG. 3 is a side view of the window mechanism 10 with the arms 14, 22 removed so as to illustrate particularly the spool 24, slide member 18 and slider mounting 16, as well as the path of cord 26. Of course, since the lever arm 14 is not illustrated in this figure, one end of the cord 26 is not terminated. The other end of cord 26 is illustrated terminating at the pivotal connection between connecting arm 22 and the runner frame 12, indicated by reference numeral 21.

Window opening/closing mechanisms according to the principles of the present invention are able to provide a number of significant advantages over other known mechanisms, one of those being the ability to maintain high opening and closing forces (ie. whilst the window or mechanism is quite close to its "closed window" configuration) while requiring only low number (say about four) of turns of the spool or handle to move the sash from a fully open number of fully closed positions. This is due, mostly, to the wedge portion of the slide member 18 in the case of opening of the window, and in view of the spool 24 being positioned so as to apply forces via the cord 26 to the end of lever arm 14 substantially at right angles to the direction of movement of the window during the final closing operation.

The window opening/closing mechanism makes use of a well known hinging arrangement for awning/casement windows, and because mechanical linkages in addition to the hinge are not necessary (a flexible cord being used instead), the potential for rattling of components is greatly reduced in the event of wind forces and the like being applied to the window. Furthermore, the window mechanism is relatively cheap to implement and can be easily operated by way of an electric motor, endless pull cord or rotatable handle when appropriately coupled to drive the spool 24. It will be recognised that the spool need not necessarily be disposed in the orientation illustrated in FIGS. 1 to 3, and many alternative configurations will be apparent which can be achieved through the use of rollers, pulleys and the like. Such arrangements may be desirable to facilitate coupling of the spool to a winding mechanism of the types mentioned above, which may also employ gears, pulleys, etc. for coupling to the spool 24.

It may be desirable in some applications to limit the possible extension of tension spring 20 to avoid over extension thereof and in that instance a cable linkage or the like may be provided between the slider mounting 16 and slide member 18, of a length corresponding to the maximum desired tension spring extension. A further tension spring may additionally be desirable between cord 26 and the projecting end of lever arm 14, arranged to provide sufficient tension of the cord coils on spool 24 to provide sufficient gripping between the cord 26 and the circumferential surface of the spool 24. Alternatively, or in addition a follower mechanism may be provided to press a portion of the cord 26 onto the surface of the spool 24 to provide the desired gripping forces for movement of the cord 26 in either direction.

Figure 5:
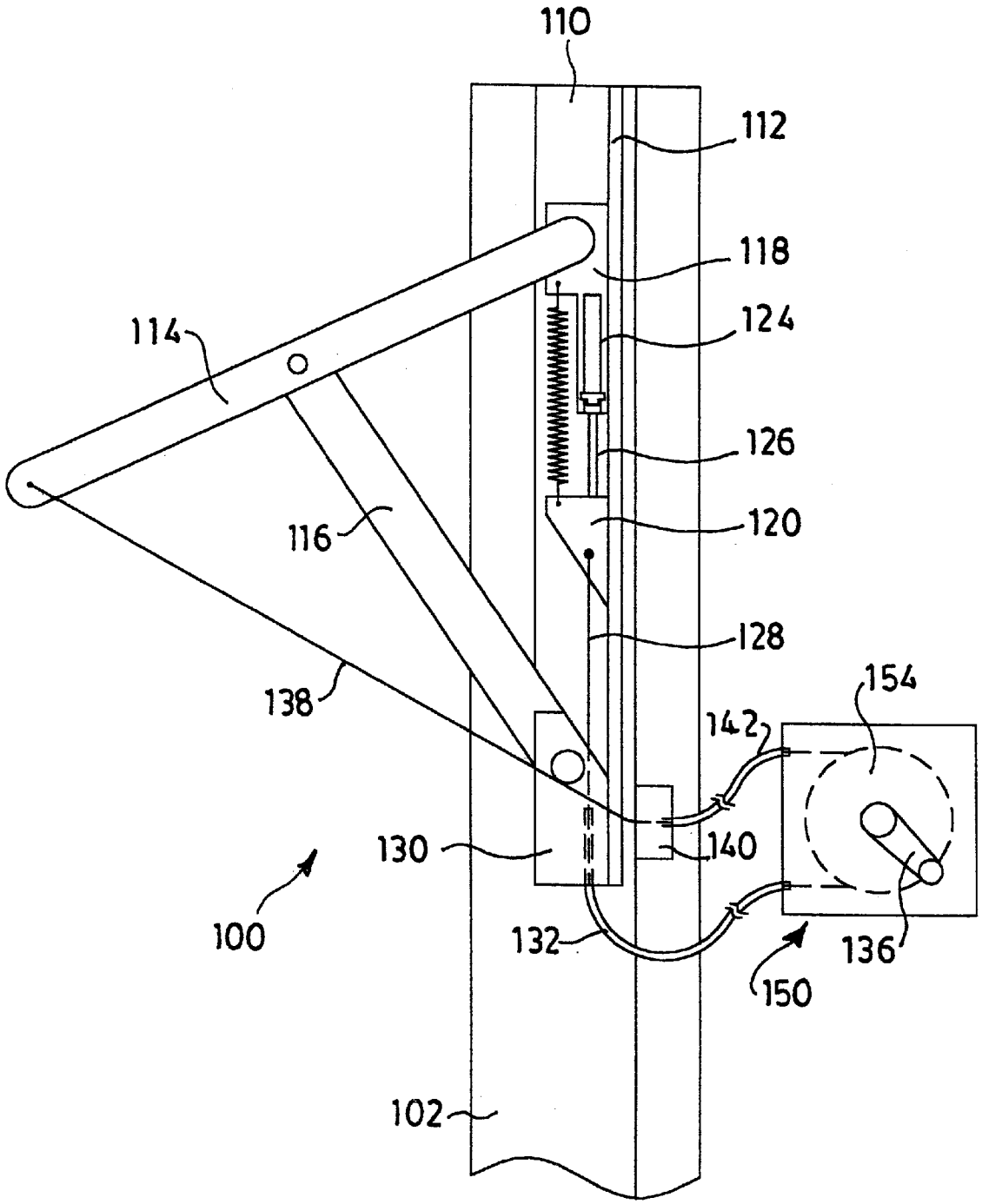
FIG. 5 is a plan view of a second embodiment of a window opening/closing mechanism constructed in accordance with the principles of the present invention.

FIG. 5 illustrates a plan view of another embodiment of a window or door opening/closing mechanism constructed in accordance with the principles of the present invention. The opening/closing mechanism 100 shown therein is illustrated mounted to a window frame 102, and many of the components and much of the operation is common to the mechanism 10 illustrated in FIGS. 1 to 3, as will be appreciated by those skilled in the art, although different reference numerals are utilised. A runner frame 110 is mounted to the window frame 102 extending generally parallel to the window frame. The runner frame 110 has a track 112 extending along one edge thereof. A slider mounting 118 is slidably mounted to the track 112 so that it may slide from a first end of the runner frame toward a second end thereof at which is mounted an end block 130. A slide member 120 is also slidably mounted to the track 112 intermediate the slider mounting 118 and end block 130.

The slide member 120 has an angled wedge surface such that the slide member tapers toward the side of the runner frame 112 at which the track is formed, in the direction of the end block 130. The slide member 120 is coupled to the slider mounting 118 by way of a tension spring 122 and respective spring limit arms 124, 126. The spring limit arm 124 extends from the slider mounting 118 toward the slide member 120, and the spring limit arm 126 extends from the slide member 120 toward the slider mounting 118. The spring limit arms 124, 126 are coupled together by way of a slot and lug arrangement, for example, to enable the slide member 120 and slider mounting 118 to move in the longitudinal direction relative to ore another to an extent which is limited by the coupling of the spring limit arms. The relative movement between the slide member 120 and slider mounting 118 in a direction away from one another extends the tension spring 122.

A lever arm 114 has a one end pivotally connected to the slider mounting 118. A connecting arm 116 has one end typically connected at the end block 130, and the other end pivotally connected at an intermediate point of the lever arm 114. The lever arm 114 is, in use, affixed to an edge of the window which fits to the window frame 102. As previously described, the lever arm 114 is pivotally movable in relation to the runner frame 110 between an orientation at which the lever arm 114, connecting arm 116 and runner frame 110 are generally parallel (window closed), to where the lever arm 114 is transverse to the runner frame 110 (window open). The opening/closing mechanism 100 illustrated in FIG. 5 is shown with the lever arm in a partially extended condition, whereby a window, if fitted, would be at least partially open. When the opening/closing mechanism 100 is in the closed condition the slider mounting 118 is at its furthest extent along the track 112 away from the end block 130. In this condition, the end of the connecting arm 116 which is coupled to the lever arm 114 is over the runner frame 110, with the wedge surface of the slide member 120 adjacent thereto. The end of the connecting arm 116 may be fitted with a shaped shoe portion (not shown) having a complementary wedge surface against which the wedge surface of the slide member can bear to improve friction and the extent to which the slide member 120 is able to angularly displace the connecting arm end, in use. When the slide member 120 is moved toward the end block 130 along the track 112, the wedge surface of the slide member forces the end of the connecting arm 116 away from the track 112, which also causes angular movement of the lever arm 114 to begin an opening movement of the mechanism 100. As the slide member 120 moves further along the track, tension is applied by way of tension spring 122 to the slider mounting 118 which causes further angular movement (opening) of the lever arm 114. Further movement of the slide member 120 causes the spring limit arms 124, 126 to reach the end of their relative travel, after which the slider mounting 118 moves with the slide member 120 until the full extent of movement is achieved, wherein the window is fully open.

Movement of the slide member 120 toward the end block 130 is achieved by applying a tension on an opening cable portion 128, which has an end attached to the slide member 120. The opening cable portion 128 extends from the slide member 120 through the end block 130, where it enters a cable sheath 132. The cable sheath 132, the opening cable portion 128 to a spool 154 of spindle mechanism 150. By rotation of a handle 136, for example, of the spindle mechanism 150, the spool 154 can be caused to rotate and wind upon itself a length of the opening cable portion 128. This then causes the slide member 120 to move toward the end block 130. A closing cable portion 138 extends from the end of lever arm 114 to a guide block 140 mounted to the window frame 102 adjacent the position achieved by the lever arm end when in the closed condition and lying generally parallel to the runner frame 110. The closing cable portion may be coupled to the window sash by way of an extension piece which extends laterally from the window sash or lever arm to where the closing cable portion is attached. This facilitates improved angular leverage for closing the window from a substantially open position. The closing cable portion 138 extends through the guide block 140 into a cable sheath 142, where it is guided also to the spool 154 in the spindle mechanism 150. The closing cable portion 138, however, is wound upon the spool 154 in the opposite direction to the opening cable portion 128. Thus, a rotation of the spool 154 which draws the opening cable portion 128 onto the spool at the same time allows a length of the closing cable 138 to unwind therefrom. Similarly, if the spool 154 is rotated in the opposite direction, a length of the closing cable 138 is wound upon the spool, whilst the opening cable portion 128 is unwound therefrom. This latter action is utilised to close the mechanism 100, by applying a tension to the closing cable portion 138 to draw the lever arm end toward the guide block 140, whilst releasing tension on the opening cable portion 128 to allow the slide member and slider mounting to move relatively away from the end block 130.

The spindle mechanism 150, coupled to the remainder of the opening/closing mechanism 100 by way of the cables 128, 138 in cable sheaths 132, 142 can be mounted in any convenient position relative to the opening/closing mechanism and window frame 102. For example, the spindle mechanism 150 may be mounted adjacent the window frame 102 for windows which are easily accessible, or may be mounted at some distance from the window frame. Additionally, although the spindle mechanism 150 is illustrated with a manually operated handle, a spool 154 of the spindle mechanism may be just as easily driven by an electric motor, pulley cord or the like for electrical or remote operation. It will be appreciated by those with experience in cable operated mechanisms that the opening and closing cords or cables need not require cable sheaths for guidance between the spindle mechanism and the remainder of the opening/closing mechanism, and other guiding means can easily be employed such as rollers and the like. Also, the cable sheaths need not be attached directly at the ends thereof, and can be provided with length adjusting means, as are known in the art, to allow for adjustability of the cable tensions whilst the mechanism is in place.

Figure 6:
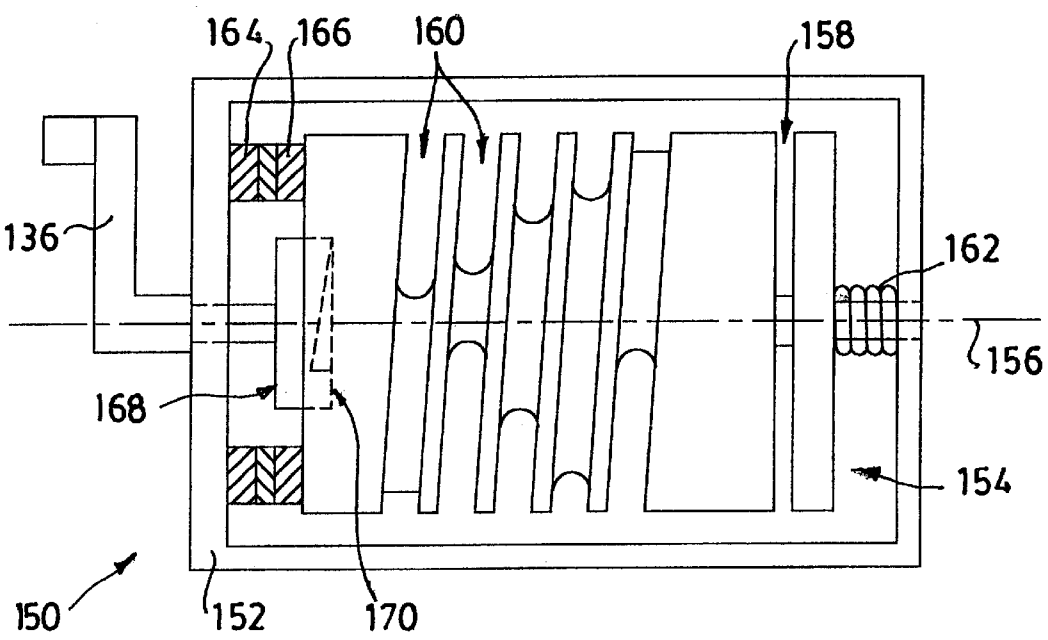
FIG. 6 is a partial cut-away view of a spindle mechanism.

FIG. 6 illustrates a partially cut-away view of one form of the spindle mechanism 150. The spindle mechanism 150 includes a housing 152 which encloses the spool 154, and has the handle 136 extending one end thereof. The spool 154 is mounted for rotational movement within the housing 152 about an axis 156. The spool 154 is provided with respective slots for receiving the opening and closing cable portions 128 and 138, respectively. The opening cable slot 158 is a single radially extending slot having the spool axle at its core at which an end of the opening cable portion 128 is secured. As the spool is rotated then, the opening cable portion 128 is wound upon itself in the slot 158 in order to draw the opening cable portion onto the spool and open the window mechanism 100. The closing cable slot 160, on the other hand, spirals along the spool axis, and has a varying radius upon which the closing cable portion 138 is wound on the spool, as illustrated in the Figure. The closing cable portion 138 has an end secured at the portion of the closing cable slot 160 axially closest to the handle 136, and as the handle 136 and spool 154 are rotated in order to wind the closing cable upon the spool (in this case in the clockwise direction when viewed from the end of the spool having the handle thereat), the closing cable portion is guided into the spirally shaped closing cable slot. It will be appreciated that the opening and closing cable portions may in fact comprise parts of a single cable length, with the opening and closing cable portions interconnecting at the spool 154. In that case it may be advantageous that the opening and closing cable slots 158, 160 be arranged differently on the spool to that illustrated, in such a way that the ends of the opening and closing cable portions can easily interconnect within the spool, for example. The cables themselves, and the cable sheathes, are not shown in this Figure.

The varying radius of the closing cable slot in the spool 154 is provided to account for differences in the relative lengths of the portions of the opening and closing cables which extend between the respective ends of the cable sheaths 132, 142 and the respective cable attachments to the opening/closing mechanism. This variation in required lengths is due to the movement of the slide member 120 relative to the slider mounting 118, the sliding movement of the pivoting end point of the lever arm 114, and the angle of the lever arm relative to the runner frame 110. Thus, by having the closing cable slot 160 arranged with a suitable variable radius over a spiral shaped slot as illustrated, the opening and closing cable portions 128, 138 may be kept generally taut over the entire range of movement of the opening/closing mechanism.

The spindle mechanism 150 is also provided with a ratchet means which provides some benefits to the operation thereof. The spool 154 has a small amount of axial movement within the housing 152 on the spool axle, and is biased toward the handle end of the housing by an axial compression spring 162. The coupling between the handle 136 and spool 154 within the housing is by way of a cam driver 168 and cam receiver 170 which operates as described below. Also, two ring-shaped cogs 164 and 166 are provided (shown in FIG. 6 in cross section), with the cog 164 fixed to the end of the housing 152 and coaxial with the spool 154, and cog 166 affixed to the end of the spool 154 to intermesh with the fixed cog 164. The intermeshing teeth on the fixed and movable cogs may be complementary saw-toothed in shape, for example. This enables a ratcheting action such that, whilst the cogs 164 and 166 are pressed together by way of the axial compression spring 162 the spool 154 can rotate under a load determined by the compression spring strength in the clockwise direction (viewed from the handle end), but is prevented from rotating in the anti-clockwise direction. In other words, the spool can rotate in a ratchet fashion in the closing direction of the window mechanism, but not in the opening direction. This means that, if the window is open and is acted upon by a strong wind or external force such as a person leaning on the window, the window opening/closing mechanism allows the window to close to a vented position by virtue of the ratchet action of the cogs 164, 166 and spring 162. However, the intermeshing teeth of the fixed and movable cogs 164, 166 prevent the window mechanism from being forced further into the open condition. The cam coupling between the handle 136 and spool 154 is provided to enable manual operation of the spindle mechanism 150 to overcome the intermeshing teeth of the cogs in order to open (and close) the window. Accordingly, a first portion of the rotation of the handle 136 in either rotational direction causes inter-acting cam surfaces on the cam driver 168 and cam receiver 170 to move the spool 154 in an axial direction against the bias of axial compression spring 162 in order to separate the teeth of the fixed and movable cogs 164, 166. This then allows further rotation of the handle 136 to cause corresponding rotation of the spool 154 for opening (or closing) of the window mechanism 100. Once the handle 136 is released, the action of the compression spring 162 forces the spool 154 back into its original axial position where the teeth of fixed and movable cogs 164, 166 intermesh.

Figure 7:
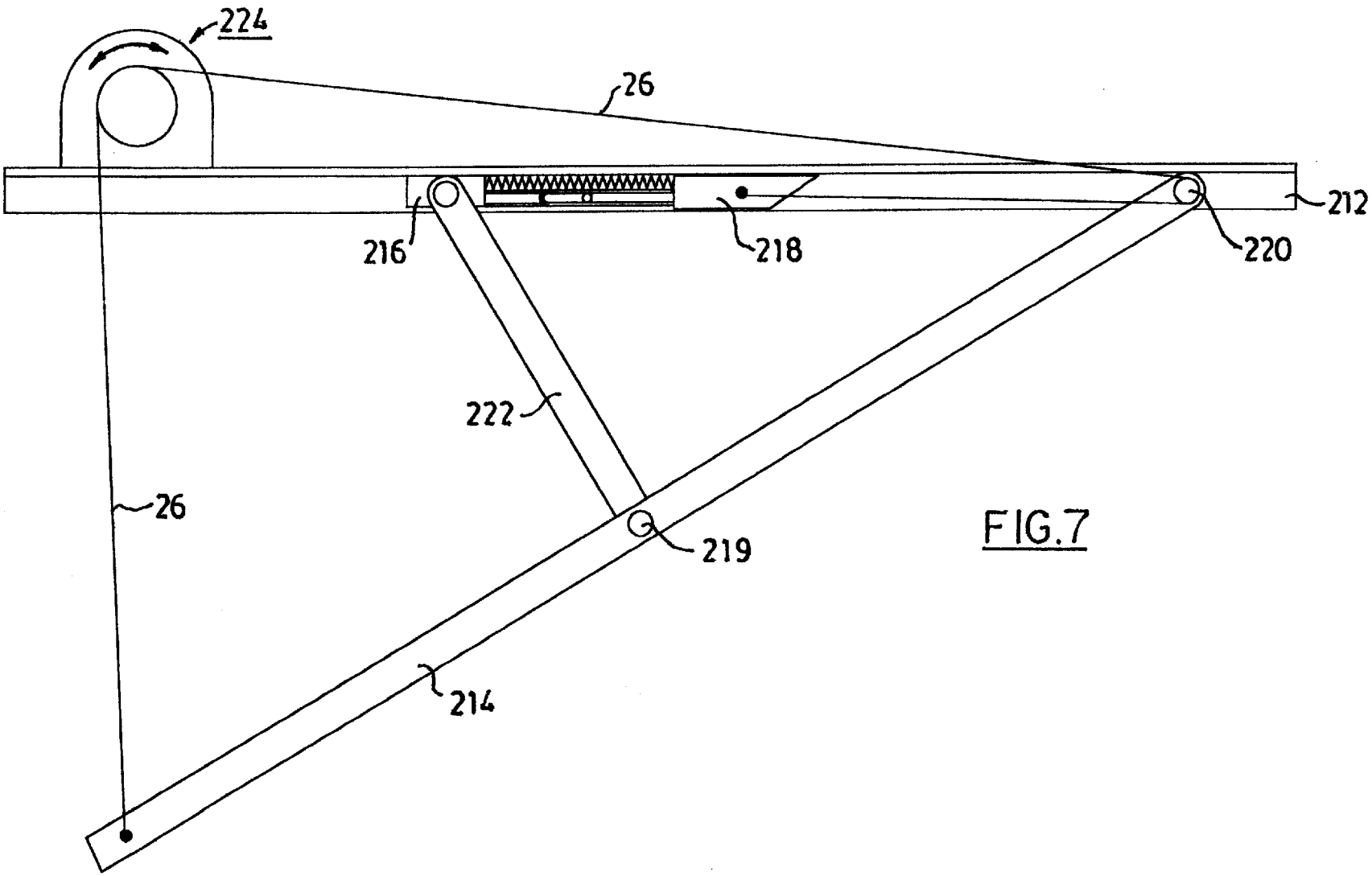
FIGS. 7 and 8 are partially schematic plan views showing two alternative arrangements of cables, a wedge, and a slider for a lever arm and connecting arm according to the invention.

The alternative preferred embodiment shown in FIG. 7 schematically illustrates the possibility of mounting connecting arm 222 on a slider 216 so that the frame end of connecting arm 222 is movable along runner or track 212 toward the pivot connection 220 for the frame end of lever arm 214. The closing pull portion of cable 26, driven by winding spool 224, connects to lever arm 214 in a similar way to what has already been explained; and the opening pull portion of cable 26 pulls on wedge 218 and in turn on slider 216. This pulls wedge 218 against the pivot connection 219 between connecting arm 222 and lever arm 214 for opening the window and also pulls slider 216 and the frame end of connecting arm 222 toward the frame end of lever arm 214. One way this can be arranged is for the opening pull portion of cable 26 to wrap around a pulley 220 arranged at the frame end of lever arm 214.

Figure 8:
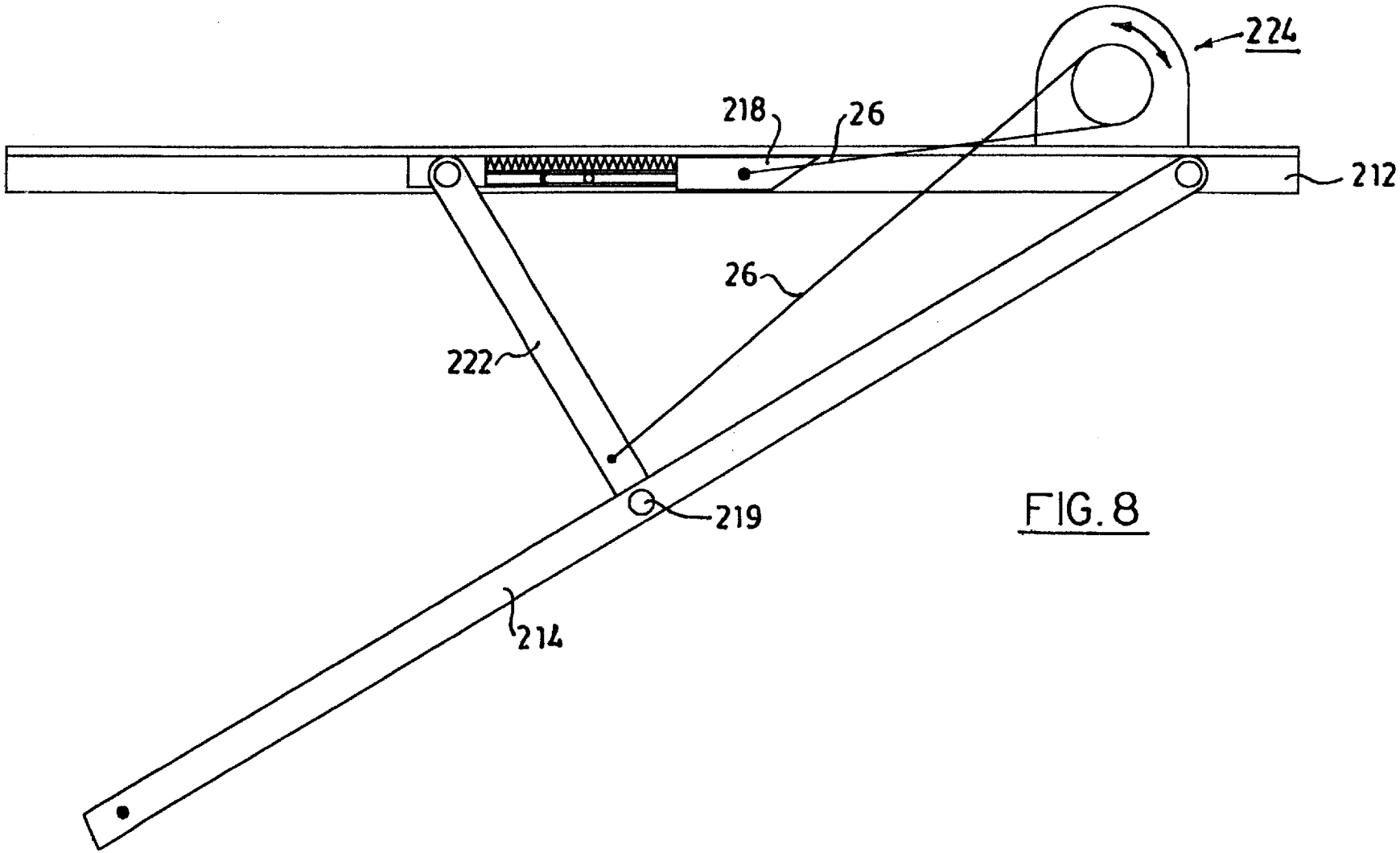

The embodiment of FIG. 8 is similar to the embodiment of FIG. 7 except that the closing pull portion of cable 26 is connected to connecting arm 222 instead of to lever arm 214, and winder 224 is moved to a more advantageous cable winding position along track 212. An opening pull on wedge 218 does not require a pulley, and a closing pull portion of cable 26 can still pull arms 222 and 214 back to a closed position where they are aligned with each other when a sash is closed.

Figure 9:
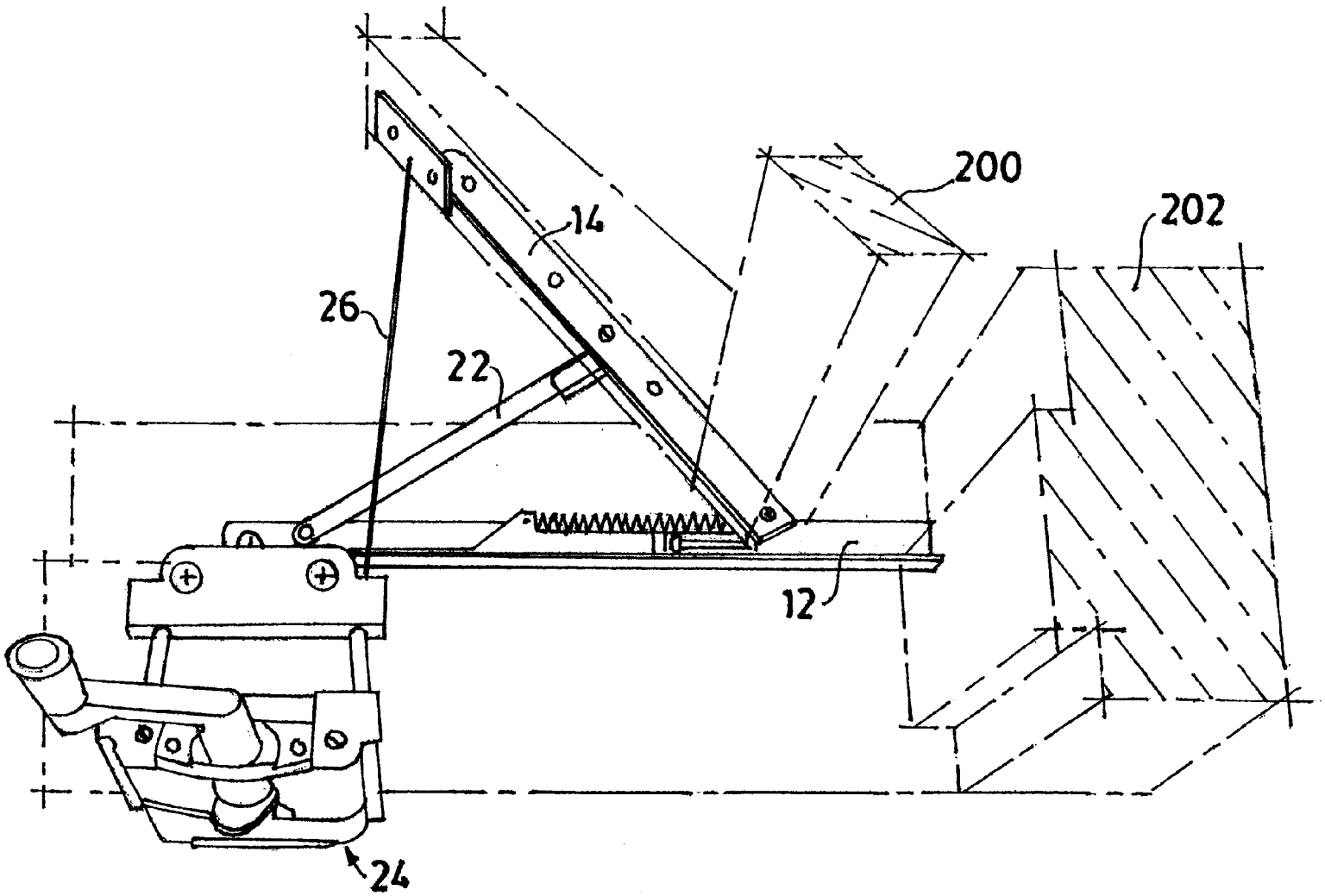
FIG. 9 is a partially schematic perspective view looking obliquely downward on a preferred embodiment of the invention applied to a casement window and frame, fragments of which are shown in broken lines.

The preferred embodiment of FIG. 9 shows a cable actuator such as disclosed in FIGS. 1–5 applied to casement sash 200 arranged within window frame 202, fragments of both of which are shown in broken lines. This illustrates how lever arm 14 is arranged along a bottom rail of sash 200 for moving the sash open and closed relative to frame 202.

Figure 10:
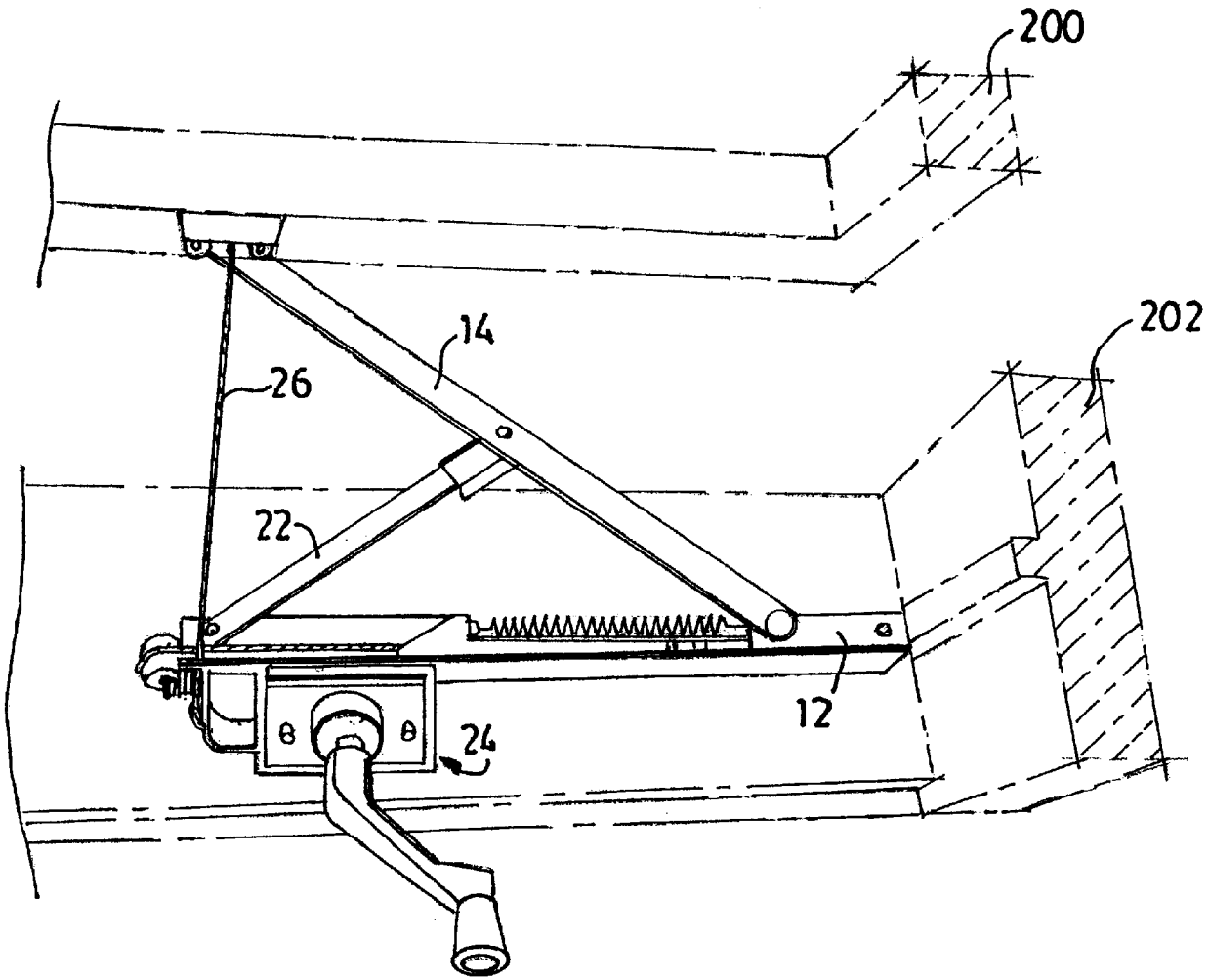
FIG. 10 is a partially schematic perspective view similar to the view of FIG. 9 showing another preferred embodiment of the invention applied to an awning window and frame, fragments of which are shown in broken lines.

The embodiment of FIG. 10 illustrates how a cable operator, such as explained above relative to FIGS. 1 and 5, is applied to opening and closing an awning sash 200 that is pivotally mounted in awning fashion within window frame 202, fragments of both of which are shown in broken lines. Lever arm 14, instead of being fastened to a sash rail, has its sash end pivotally connected to sash 200 as illustrated. Lever arm 14 moves between open and closed positions as previously explained, and the sash end of lever arm 14 moves a bottom rail of awning sash 200 open or away from frame 202 and closed or secured within frame 202.

It will be appreciated by those skilled in the art that many alternative arrangements are possible, in addition to those shown and described in relation to the foregoing embodiments, whilst remaining within the scope of the present invention. For example, whilst most of the foregoing description has been in the context of mechanisms for opening and closing windows, the present invention can be equally applied to mechanisms for opening and closing doors and fixed hinge windows. In such a case, it may be desirable that the hinging point of the door be fixed, in which case the mounting 118 of the pivotal end of lever arm 114 may be fixed to the runner frame, and the end block 130 which holds the pivotal connection of connecting arm 116 could be constructed so as to slide along the track 112 of the runner frame. A more likely construction may involve a sliding end block 130 together with separate external hinging of the door or window in conventional manner so that the door or window does not hinge about a pivot of a lever arm mounted to the runner frame. In that case, the function of the lever arm 114 and lever arm pivot mounting 118 is performed by the window sash or door edge in conjunction with the separate hinging thereof on the window/door frame to which the runner frame is mounted. The closing cable portion may be coupled directly to the window sash or door edge in such a case, by way of a cable termination fitting, for example.

Furthermore, whilst the foregoing detailed description is in the context of the runner frame 110 being attached to the window frame and the lever arm 114 attached to the edge of the window sash, it is equally possible for the opposite to apply, with the lever arm 114 being fixed to the window or door frame and the runner frame 110 being fixed to the edge of the door or window, although that is not the preferred arrangement.

It may be desirable in some applications to arrange two of the window mechanisms in tandem, to operate on opposite sides or ends of the window simultaneously, and it will be readily recognised that this can be easily achieved by coupling the spools of the two mechanisms together for simultaneous rotation. Furthermore, whilst the embodiments of the invention have been described with a single spool for each mechanism, it also possible for the opening and closing cable portions to wind on separate spools, which may be geared together to operate from a single actuating mechanism (e.g., handle, pulley, motor). In another variation, although the window mechanism has been described herein in the context of a three-bar hinge, four and five bar window casement and awning hinges also exist which may be adapted for use in a window opening and closing mechanism according to the principles of the present invention as disclosed herein.

It will be appreciated by those of ordinary skill in the art that the foregoing description of an embodiment of the present invention is not intended to be limiting to the invention, and many variations and modifications can be made to the described construction whilst remaining within the bounds of the principle of the invention. Thus, the foregoing detailed description has been presented by way of example only, and is not intended to be considered limiting to the invention as defined in the claims appended hereto.

I claim:

1. An opening and closing mechanism for a window or door comprising an elongate frame member, first and second pivot mount members coupled to the frame member towards opposite ends thereof and at least one of the first and second pivot mount members being slidable along the frame member so that the first and second pivot mount members are movable relative to one another, a lever arm having one end pivotally coupled to the first pivot mount member to enable pivotal movement thereof relative to the frame member between a closed position where the lever arm is substantially parallel to the frame member and an open position where the lever arm is transverse to the frame member, a connecting arm having one end pivotally coupled to the second pivot mount member and the other end pivotally coupled at an intermediate portion of the lever arm, an opening cord or cable portion which is coupled to one or both of the first and second-pivot mount members for applying a force therebetween to effect relative movement of the first and second pivot mount members toward each other along the frame member for opening of the window or door, a closing cord or cable portion which is coupled between the connecting arm or lever-arm and the frame member for applying a force therebetween to effect relative angular movement of the lever arm and connecting arm toward the frame member for closing of the window or door, and a winding mechanism for winding and unwinding the opening and closing cord or cable portions to apply said forces for opening and closing of the window or door.

2. An opening and closing mechanism as claimed in claim 1, wherein at least one of the pivot mount members includes a wedge member positioned to slide along the frame member between the second pivot mount member and a lever arm mounting of the first pivot mount member, and wherein the wedge member is coupled to the opening cord or cable portion and is relatively movable with respect to the at least one pivot mount member over a limited distance along the frame member.

3. An opening and closing mechanism as claimed in claim 2, wherein the wedge member is coupled to the at least one pivot mount member by way of a tension spring and sliding spring limit arms interconnecting the wedge member and the at least one pivot mount member to limit the separation thereof and thus limit extension of the tension spring.

4. An opening and closing mechanism as claimed in claim 3, wherein the wedge member has a wedge surface which, upon relative movement of the first and second pivot mount members toward one another, acts against the end of the -connecting arm coupled to the lever arm to force the connecting arm and lever arm angularly out from the frame member.

5. An opening and closing mechanism as claimed in claim 1, wherein the winding mechanism includes a rotatable spool upon which the opening and closing cord or cable portions are wound, in use, and wherein the opening and closing cord or cable portions are coupled around the spool such that winding the opening cord or cable portion onto the spool unwinds the closing cord or cable portion therefrom, and vice versa.

6. An opening and closing mechanism as claimed in claim 5, wherein the opening and/or closing cord or cable portion is coupled between the winding mechanism and the frame member by way of a cable sheath.

7. An opening and closing mechanism as claimed in claim 5, wherein the opening and closing cord or cable portions are integrally formed and wound upon the spool in at least one spiral loop.

8. An opening and closing mechanism as claimed in claim 5, wherein the spool includes separate guiding slots for the opening cord or cable portion and the closing cord or cable portion, and wherein each of the opening and closing cord or cable portions have an end portion affixed in relation to the spool.

9. An opening and closing mechanism as claimed in claim 8, wherein the guiding slot in the spool for the closing cable portion is formed in a spiral and has a variable winding radius.

10. An opening and closing mechanism as claimed in claim 5, wherein the opening and/or closing cable portion is arranged to wind upon itself around the spool.

11. An opening and closing mechanism as claimed in claim 5, wherein the winding mechanism includes a driving means for effecting driven rotation of the spool.

12. An opening and closing mechanism as claimed in claim 11, wherein the winding mechanism is provided with a ratchet mechanism which allows rotation of the spool in one direction by application of tension on the opening cable, and prevents rotation of the spool in the other direction upon application of tension on the closing cable.

13. An opening and closing mechanism as claimed in claim 12, wherein the driving means is coupled to the spool by way of a cam action mechanism to disengage said the ratchet mechanism an allow the driving mechanism to drive the spool.

14. An opening and closing mechanism as claimed in claim 1, wherein the at least one pivot mount member is slidable along the frame member.

15. An opening and closing mechanism as claimed in claim 14, wherein the at least one pivot mount member is the first pivot mount member.

16. An opening and closing mechanism as claimed in claim 1, wherein the second pivot mount member is fixed to the runner frame and the first pivot mount member is movable along the frame.

17. An opening and closing mechanism as claimed in claim 1, wherein the closing cord or cable portion extends from a spool of the winding mechanism, through a cable sheath, to the lever arm, and wherein the cable sheath has one end fixed to the winding mechanism and the other end fixed to a guide block which is incorporated in or adjacent the frame member.

18. An opening and closing mechanism as claimed in claim 1, wherein the opening cord or cable portion extends from a spool of the winding mechanism, through a cable sheath, to the first pivot mount member, and wherein the cable sheath has one end fixed to the winding mechanism and the other end fixed to a guide block which is incorporated in or adjacent the second pivot mount member.

19. An opening and closing mechanism as claimed in claim 1, wherein the opening cord or cable portion has an end attached to the first pivot mount member.

20. An opening and closing mechanism as claimed in claim 1, wherein the opening cord or cable portion is coupled to the first pivot mount member through an aperture, roller, pulley or the like and has an end affixed to the frame member.

21. An opening and closing mechanism in combination with a window or door having a window or door frame, the mechanism having a lever arm, a connecting arm, and a pivotal connection between the lever and connecting arms, which are aligned with each other when the window or door is closed, one of the lever and connecting arms being pivotally connected to the frame via a slider that moves along a track secured to the frame, and the other of the lever and connecting arms being pivotally connected to the frame or track, the mechanism comprising:

a. a wedge connected to the slider via an extendable bias element that allows the wedge to move along the track away from and toward the slider;

b. a cable system including a winder and a cable operatively connected with the winder;

c. the cable being connected to the wedge so that opening tension applied to the cable moves the wedge away from the slider; and d. movement of the wedge away from the slider being arranged to engage the wedge and the pivotal connection between the lever and connecting arms to move the lever and connecting arms out of alignment with each other.

22. The mechanism of claim 21, wherein the lever arm is pivotally connected to the slider.

23. The mechanism of claim 22, wherein the wedge connection to the slider limits the movement of the wedge away from the slider.

* * * * *